US008651178B2

(12) United States Patent
Mercer et al.

(10) Patent No.: US 8,651,178 B2
(45) Date of Patent: Feb. 18, 2014

(54) PACKER

(75) Inventors: Lee Mercer, Inveruries (GB); Iain Macleod, Newmachar (GB)

(73) Assignee: Petrowell Limited, Aberdeen (GB)

( * ) Notice: Subject to any disclaimer, the term of this patent is extended or adjusted under 35 U.S.C. 154(b) by 611 days.

(21) Appl. No.: 12/294,078

(22) PCT Filed: Mar. 22, 2007

(86) PCT No.: PCT/GB2007/001040

§ 371 (c)(1),
(2), (4) Date: Jun. 15, 2009

(87) PCT Pub. No.: WO2007/107773

PCT Pub. Date: Sep. 27, 2007

(65) Prior Publication Data

US 2009/0308592 A1 Dec. 17, 2009

(30) Foreign Application Priority Data

Mar. 23, 2006 (GB) ..... 0605831.7
Aug. 7, 2006 (GB) ..... 0615634.3

(51) Int. Cl.
*E21B 33/12* (2006.01)

(52) U.S. Cl.
USPC ..... 166/121; 166/134; 166/138; 166/179; 166/202

(58) Field of Classification Search
USPC ..... 166/179, 202, 121, 134, 138
See application file for complete search history.

(56) References Cited

U.S. PATENT DOCUMENTS

| | | | |
|---|---|---|---|
| 643,358 | A | 2/1900 | Konold |
| 2,009,322 | A | 7/1935 | Emil |
| 2,181,748 | A | 11/1939 | Thaheld |
| 2,498,791 | A | 2/1950 | Clark |
| 2,546,377 | A | 3/1951 | Turechek |
| 2,738,018 | A | 3/1956 | Lynes |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

International Search Report for PCT/GB2009/000730, Sep. 24, 2009.

(Continued)

*Primary Examiner* — Yong-Suk (Philip) Ro
(74) *Attorney, Agent, or Firm* — Wong, Cabello, Lutsch, Rutherford, & Brucculeri LLP

(57) ABSTRACT

A packer for a well. The packer comprises a seal element and seal setting apparatus. The seal setting apparatus is moveable with respect to the seal element in a setting direction to apply a setting force to the seal element to move the seal element from a run-in configuration to a set configuration in which, in use, the seal element forms a contact seal with a conduit wall. In use, the packer is arranged such that, in the set configuration, a pressure differential across the packer, which creates a force in the setting direction, will increase the setting force applied by the seal setting apparatus to the seal element to maintain the seal.

74 Claims, 14 Drawing Sheets

(56) References Cited

U.S. PATENT DOCUMENTS

| | | | |
|---|---|---|---|
| 2,832,418 | A | 4/1958 | Baker |
| 3,066,738 | A | 12/1962 | Myers |
| 3,087,552 | A | 4/1963 | Graham |
| 3,167,127 | A | 1/1965 | Sizer |
| 3,167,128 | A | 1/1965 | Sutliff |
| 3,283,821 | A | 11/1966 | Brown |
| 3,342,268 | A | 9/1967 | Brown |
| 3,371,716 | A | 3/1968 | Current |
| 3,482,889 | A | 12/1969 | Cochran |
| 3,623,551 | A | 11/1971 | Randermann |
| 3,722,588 | A | 3/1973 | Tamplen |
| 3,729,170 | A | 4/1973 | Lewis |
| 3,889,750 | A | 6/1975 | Mullins |
| 4,044,826 | A | 8/1977 | Crowe |
| 4,046,405 | A | 9/1977 | Bonds |
| 4,127,168 | A | 11/1978 | Hanson |
| 4,317,485 | A | 3/1982 | Ross |
| 4,331,315 | A | 5/1982 | Geisow |
| 4,346,919 | A | 8/1982 | Morrill |
| 4,375,240 | A | 3/1983 | Baugh |
| 4,588,030 | A | 5/1986 | Blizzard |
| 4,917,187 | A | 4/1990 | Burns |
| 4,924,941 | A | 5/1990 | Farley |
| 2,230,447 | A | 2/1991 | Bassinger |
| 5,010,958 | A | 4/1991 | Meek et al. |
| 5,058,684 | A | 10/1991 | Winslow |
| 5,095,978 | A | 3/1992 | Akkerman |
| 5,261,488 | A | 11/1993 | Gullet |
| 5,404,944 | A | 4/1995 | Lynde et al. |
| 5,487,427 | A | 1/1996 | Curington |
| 5,542,473 | A | 8/1996 | Pringle |
| 5,862,861 | A | 1/1999 | Kalsi |
| 6,062,309 | A | 5/2000 | Gosse |
| 6,315,041 | B1 | 11/2001 | Carlisle |
| 7,690,424 | B2 | 4/2010 | MacLeod et al. |
| 2003/0000607 | A1 | 1/2003 | Jenner |
| 2004/0055757 | A1 | 3/2004 | Beall |
| 2005/0224227 | A1 | 10/2005 | Hendrie |
| 2007/0017683 | A1 | 1/2007 | O'Malley |
| 2009/0200042 | A1 | 8/2009 | Emerson |
| 2009/0308592 | A1 | 12/2009 | Mercer |

FOREIGN PATENT DOCUMENTS

| | | |
|---|---|---|
| EP | 0453052 | 10/1991 |
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2224526 A | 5/1990 |
| GB | 2245624 | 8/1992 |
| GB | 2328230 | 2/1999 |
| GB | 2005121498 | 12/2005 |
| GB | 2428708 | 2/2007 |
| WO | WO02/42672 | 5/2002 |
| WO | WO 2005/026494 | 3/2005 |
| WO | WO 2006/046075 | 5/2006 |
| WO | WO 2007/109878 | 10/2007 |

OTHER PUBLICATIONS

Written Opinion for PCT/GB2009/000730, Sep. 18, 2010.
Office Action, Applicant's co-pending U.S. Appl. No. 11/909,820, Oct. 7, 2010.
International Search Report for PCT/GB2009/000770, Oct. 8, 2009.
Written Opinion for PCT/GB2009/000770, Sep. 29, 2010.
Pursuant to MPEP § 2001.6(b) applicants bring the following co-pending applications to the Examiner's attention: U.S. Appl. Nos. 12/933,053, and 12/933,015.
UKIPO Examination Report, GB0817688.5, dated Oct. 8, 2010.
Search Report, GB1110379.3, dated Jun. 30, 2011 from United Kingdom Intellectual Property Office.
Office Action dated Jun. 20, 2011, Applicant's co-pending U.S. Appl. No. 11/909,820.
pct-gb2005-001391, Int'l Prelim. Report on Patentability, Jun. 23, 2005.
pct-gb2005-001391, International Search Report, Jun. 23, 2005.
pct-gb2005-001391, Written Opinion, Jun. 23, 2005.
pct-gb2005-004200, Written Opinion, Apr. 10, 2006.
pct-gb2005-004200, Int'l Prelim. Report on Patentability, May 1, 2007.
pct-gb2005-004200, International Search Report, Jan. 11, 2006.
pct-gb2005-003871 Int'l Prelim. Report on Patentability, Sep. 11, 2007.
pct-gb2005-003871, International Search Report, Nov. 17, 2005.
Office Action dated Mar. 30, 2009, Applicant's co-pending U.S. Appl. No. 11/816,421, filed Mar. 30, 2009.
Office Action dated Sep. 28, 2009, Applicant's co-pending U.S. Appl. No. 11/816,421, filed Sep. 28, 2009.
Foreign Office Action dated Nov. 1, 2005.
pct-gb2005-003871, Written Opinion, Nov. 22, 2005.
pct-gb-2006001297, Int'l Prelim. Report on Patentability and Written Opinion, Oct. 9, 2007.
pct-gb-2006001297, International Search Report, Oct. 9, 2007.
Office Action dated May 29, 2009, Applicant's co-pending U.S. Appl. No. 11/909,820, filed May 29, 2009.
Office Action dated Feb. 17, 2010, Applicant's co-pending U.S. Appl. No. 11/909,820, filed Feb. 19, 2010.
pct-gb-2007004372, Int'l Prelim. Report on Patentability and Written Opinion, May 19, 2009.
pct-gb-2007004372, International Search Report, Jan. 23, 2008.
pct-gb-2008002042, Int'l Prelim. Report on Patentability and Written Opinion, Dec. 20, 2009.
pct-gb-2008002042, International Search Report, Oct. 17, 2008.
pct-gb-2009071874, Int'l Prelim. Report on Patentability and Written Opinion, Jun. 8, 2010.
pct-gb-2009071874, International Search Report, Jul. 23, 2009.
pct-gb2008003883, Int'l Prelim. Report on Patentability and Written Opinion, May 25, 2010.
pct-gb-2008003883, International Search Report, Mar. 26, 2009.
PCTGB200900048300, Int'l Prelim. Report on Patentability and Written Opinion, Aug. 24, 2010.
PCTGB200900048300, International Search Report, Sep. 28, 2009.
Office Action dated Aug. 25, 2010, Applicant's co-pending U.S. Appl. No. 11/577,866, filed Aug. 25, 2010.
Office Action dated Oct. 7, 2010, Applicant's co-pending U.S. Appl. No. 11/909,820, filed Oct. 7, 2010.
Written Opinion of the International Searching Authority Re PCT/GB2007/001040.
International Search Report Re PCT/GB2007/001040.
International Preliminary Report of Patentability Re PCT/GB2007/001040.

PACKER

FIELD OF THE INVENTION

The present invention relates to packers and particularly to packers for forming a seal with a formation surface.

BACKGROUND OF THE INVENTION

In an oil well it is often necessary to seal a section of the annulus between the formation surface and a tubular conduit, or between the casing or liner and a tubular conduit. Packers are widely used to create such a seal.

Conventional packers generally employ a rubber inflatable element which is inflated into engagement with the rock surface or an element which expands under the action of a setting force into engagement with the rock surface.

Conventional packers, however, have associated drawbacks. Once installed a substantial pressure differential can exist across the element, and the inflation or setting pressure applied has to be sufficient to withstand these differential pressures. Due to the level of setting or inflation pressure which is applied to the element to withstand the potential differential pressures, at the point of contact between the seal element and the formation, the formation can be put under a great deal of stress. This stress can cause the rock to fail. Failure of the rock may require that the packer be moved and reset at a different location.

Furthermore, particularly with inflatable packers, the differential pressure can result in movement of the element, which, in turn, can cause mechanical wear, resulting in damage to the element. In the case of an inflatable element, such damage can permit a liquid inflation medium to leak out.

It is an object of the present invention to obviate or mitigate at least one of the aforementioned disadvantages.

SUMMARY OF THE INVENTION

According to a first aspect of the present invention there is provided a packer for a well, the packer comprising:

a seal element; and seal setting apparatus being moveable with respect to the seal element in a setting direction to apply a setting force to the seal element to move the seal element from a run-in configuration to a set configuration in which, in use, the seal element forms a contact seal with a conduit wall;

wherein, in use, the packer is arranged such that, in the set configuration, a pressure differential across the packer, which creates a force in the setting direction, will increase the setting force applied by the seal setting apparatus to the seal element to maintain the seal.

It will be understood that the term "conduit" covers any channel for conveying water or other fluid. Particularly, conduit covers a drilled bore, whether lined or unlined, and metal, plastic and composite tubulars.

It will be further understood, the term "well" includes injection, gas, water producing and oil wells.

The provision of a packer which, when used to seal an annulus between a tubular and an unlined well bore, applies only sufficient force to the formation to form a contact seal, minimises the possibility of formation failure caused by over pressurising the formation as the packer is set. In the event that a pressure differential across the packer is established which creates a force on the seal setting apparatus in the setting direction, for example by an increase in the formation pressure, the force will be harnessed by the packer to increase the setting force applied by the seal setting apparatus to the seal element, thereby maintaining the seal in the higher pressure environment.

An embodiment of the packer of the present invention can be used with formation engaging members described in the applicant's co-pending International Patent Application PCT/GB2005/003871.

An embodiment of the present invention can be used as an alternative sealing system to that described in the applicant's co-pending International Patent Application PCT/GB2005/001391.

An embodiment of the present invention can be used as an alternative packer element to that described in the applicant's co-pending United Kingdom Patent Application GB0507237.6.

Preferably, the packer further comprises a mandrel, the mandrel defining a packer throughbore.

Preferably, the seal element comprises a cup seal.

Preferably, the seal element has a sealing surface for forming a seal, in use, with a conduit wall.

Preferably, the packer is adapted to seal an annulus between a conduit wall and a tubular.

Preferably, where the seal element comprises a cup seal, the sealing surface is a portion of the outside surface of the seal element.

Preferably, the sealing surface includes a profiled portion.

Preferably, the sealing surface is profiled.

Preferably, the profile is a corrugated profile. A corrugated profile provides a greater available area for contact between the seal element and the conduit wall. Furthermore, a profiled surface is better suited to sealing with non-uniform surfaces, for example in open hole environments. A corrugated profile defines peaks, which engage the conduit wall, and troughs. Such an arrangement realises benefits as the seal element is set in a conduit containing fluid because some of the fluid between the seal element and the conduit wall can remain in the troughs as opposed to having to be driven out, as is the case in conventional seal elements. The tips of the peaks, which engage the conduit wall, provide areas of high contact stress for maintaining the desired seal. A corrugated profile also provides for redundancy in that the each corrugation acts like an O-ring and if one corrugation fails, further corrugations are provided to maintain the seal.

Preferably, the seal element comprises an elastomeric material. An elastomeric seal element can adapt to non-uniform surfaces and non-round conduits. Non-round conduits can occur in formations where the hole has been drilled non-round or where geology changes over time result in a non-round hole.

Alternatively or additionally the seal element comprises a metallic material.

Preferably, the seal element comprises rubber.

Most preferably, the seal element is solid.

Preferably, the seal setting apparatus is adapted to engage a first portion of the seal element, such that, in use, the sealing surface of the seal element forms a seal with a conduit.

Preferably, where the seal element is a cup seal, the seal setting apparatus engages a portion of the inside surface of the seal element.

Preferably, at least one first portion of the seal element is fixed with respect to the mandrel.

Preferably, at least one second portion of the seal element is releasably fixed with respect to the mandrel.

Preferably, the/each seal element second portion is releasably fixed with respect to the mandrel in the run-in configuration. Releasably fixing the/each seal element second portion with respect to mandrel improves the swab resistance of the packer, that is, the packer resists moving from the run-in to the set configuration as the packer is moved into position through a fluid.

Preferably, movement of the seal setting apparatus from the run-in configuration to the set configuration releases the/each second portion.

Preferably, the/each second portion is fixed to a packer band.

Preferably, the/each second portion is releasably fixed to the packer band.

Preferably, the packer band is fixed with respect to the mandrel.

Preferably, the/each second portion is bonded to the packer band.

Alternatively, the packer band defines a retaining member to retain the/each second seal portion.

Preferably, the retaining member defines a C-section.

Preferably, the seal setting apparatus comprises at least one elongate element.

Preferably, the seal setting apparatus comprises a plurality of elongate elements.

Preferably, the/each elongate element has a first end and a second end.

Preferably, the first end of the/each elongate element is fixed relative to the mandrel.

Preferably, in the run-in configuration, the/each elongate element is arranged substantially axially with the packer mandrel.

Using a plurality of axially extending elongate elements in contact and applying a setting force to the inside surface of a cup seal element, permits each elongate element and the seal element to conform and seal in non-round holes, as each elongate element can apply pressure substantially independently of neighbouring elongate elements sufficient to achieve engagement between a portion of the seal element and a portion of the conduit wall. This arrangement also permits the packer to conform to changes in the geometry over the hole over time. This is advantageous because over time the shape of the hole may change from round to non-round.

Preferably, the plurality elongate elements are a plurality of leaf springs.

Preferably, a seal element bypass is provided to, in use, relieve a pressure differential across the packer which creates a force in a direction opposite the setting direction.

Preferably, the bypass includes a seal which only seals in one direction.

Preferably, the bypass seal is a V-seal.

Preferably, the first end of the/each elongate element is connected to a collar.

Preferably, the collar is mounted to the mandrel.

Preferably, the collar defines a groove adapted to accommodate the bypass seal.

Preferably, the groove is located such that the bypass seal forms a one way seal against the mandrel. In this case, a pressure differential across the packer which creates a force in a direction opposite the setting direction can be relieved between the mandrel and the seal collar ensuring the integrity of the seal between the seal element and the conduit wall is not compromised.

Preferably, where there are a plurality of elongate elements, the elongate elements are arranged in a plurality of concentric layers.

Most preferably, there are two concentric layers.

Preferably, the two concentric layers are an outer layer and an inner layer.

Preferably, the inner layer of elongate elements are relatively thick compared to the outer layer. The inner layer elongate elements are thicker to provide stiffness to the arrangement of elongate elements. The outer layer of elongate elements are thinner to distribute the radial pressure on the seal element substantially evenly.

Preferably, the elongate elements in the outer layer overlap the elongate elements in the inner layer. Overlapping elements allow the seal setting apparatus to expand from the run-in configuration to the set configuration whilst maintaining a continuous surface for supporting the seal element. Gaps between the elongate elements on the inner layer, created as the seal setting apparatus expands, are covered by elongate elements in the outer layer and vice versa.

Preferably, the outer layer of elongate elements are adjacent the seal element.

Most preferably, a protective layer is sandwiched between the seal element and the at least one elongate element. A protective layer can be utilised to protect the seal element from damage as the elongate elements move from the run-in configuration to the set configuration.

Alternatively, the protective layer is integral with the seal element. In this case the protective layer may be moulded as part of, or bonded to, the seal element.

The protective cover may be unitary. Alternatively, the protective layer may comprise a plurality of layer elements.

Preferably, the protective layer comprises a polymeric material.

Preferably, the protective layer is a low friction material, such as PTFE.

Preferably, the second end of each elongate element includes engagement means for engaging one or more elongate element in the adjacent layer.

In one embodiment, the seal setting apparatus comprises a plurality of setting members.

Preferably, each setting member is adapted to engage and apply at least a portion of the setting force to the/each elongate element. The use of a plurality of setting members to set the seal element provides the capacity for setting the seal element in a non-round hole, each setting member applying at least a portion of the setting force to a different part of the seal element.

Preferably, the setting members are adapted to move with respect to the packer mandrel.

Preferably, the setting members are adapted to move axially.

Preferably, each setting member comprises a body and a lever.

Alternatively, each setting member comprises a body and a wedge.

Preferably, each lever or wedge is adapted to engage and apply the at least a portion of the setting force to the/each elongate element.

Preferably, the lever is hingedly attached to the body.

Preferably, the lever is hingedly attached to the body by a living hinge.

Preferably, as the setting members move with respect to the mandrel, at a predetermined location, the levers are prevented from further axial movement with respect to the/each elongate element.

Preferably, further axial movement of each setting member body causes each setting member's respective lever to pivot with respect to the body.

Preferably, each lever is adapted to pivot radially outwards.

Preferably, each lever pivots towards the/each elongate element. The pivoting action pushes the/each elongate element and the seal element outwards. Such an arrangement permits a large radial movement of the seal element for a relatively short axial movement of the setting member body.

Preferably, the seal setting apparatus further comprises at least one web.

Preferably, the at least one web is axially extending.

Preferably, the at least one web is fixed with respect to the mandrel.

Preferably, a web is located between adjacent seal setting members.

Preferably, the/each web is adapted to prevent lateral movement of adjacent seal setting members.

Preferably, the seal setting apparatus further comprises at least one restraining member.

Preferably, a restraining member is associated with a plurality of seal setting members.

Preferably, the/each restraining member is adapted to restrain the movement of one seal setting member with respect to an adjacent seal setting member. Being able to restrain the movement of one seal setting member with respect to an adjacent seal setting member prevents, in one embodiment, over extension of one part of the seal element with respect to another portion.

Preferably, each pair of seal setting members is adapted to move with respect to their associated restraining member.

In an alternative embodiment, the seal setting apparatus further comprises a prop for supporting the/each elongate element and a setting sleeve, the prop being mounted on the setting sleeve.

Preferably, the setting sleeve is adapted to move axially with respect to the packer mandrel.

Preferably, the setting sleeve and the prop are adapted to engage and apply the setting force to the/each elongate element.

Preferably, movement of the setting sleeve in the setting direction towards the/each elongate element forces the/each elongate element to move from the run-in configuration to the set configuration.

Preferably, the prop comprises a compliant portion. A compliant portion is provided to permit the prop to adapt and maintain a seal in, along with the seal element and the elongate elements, a non-round hole. The compliant portion also serves to transfer the force created in the setting direction by a pressure differential to the seal element through the elongate elements.

Preferably, the seal setting apparatus further comprises a prop support sleeve, mounted concentrically to the setting sleeve. The prop support sleeve supports and applies pressure to the back of the prop to maintain engagement between the prop and the/each elongate element.

Preferably, the prop support sleeve can move axially along the setting sleeve.

Preferably, the prop support sleeve is releasably fixable to the setting sleeve.

Preferably, the prop compliant portion is covered with an anti-extrusion covering.

Preferably, the setting sleeve and the prop support sleeve are axially movable by an externally applied force. The externally applied force may be mechanically or hydraulically applied. Alternatively, any suitable means of applying pressure may be employed.

The prop may comprise a polymeric material. Alternatively or additionally, the prop may comprise a fluid prop or may be fluid filled.

In one embodiment hydrostatic pressure acting on an atmospheric chamber is used to generate the externally applied force.

Preferably, the setting force includes the externally applied force.

Preferably, the setting force is applied by hydrostatic pressure acting on an atmospheric chamber.

Preferably, the packer further comprises at least one spring. One or more springs may be provided to form a low pressure seal between the seal element and a conduit wall. This force can maintain a low pressure seal in the absence of, or where there is a reduced pressure differential, across the seal which may be insufficient to energise the seal.

Preferably, where the seal setting apparatus comprises a plurality of setting members, the/each spring is adapted to act on each setting member.

Preferably, the setting force is transmitted to the seal setting apparatus through the/each each spring.

Preferably, the spring acts on each setting member through a relief device.

Preferably, there is a relief device associated with each setting member.

Preferably, each relief device is adapted to transmit the setting force to the device's respective setting member.

Preferably, each relief device is adapted to transmit no more than a pre-determined force to the device's respective setting member. Such an arrangement ensures that a particular setting member does not apply too much force to the seal element. This is important in open hole applications, as applying too much stress to the formation can damage the formation. This arrangement also ensures that, when sealing non-round holes, the parts of the seal element which engage the conduit wall first are not overstressed whilst the remainder of seal element moves into contact with the conduit wall. In such a case, once the setting force on the engaged portion of the seal element reaches the pre-determined force, the relief device prevents the setting member associated with that portion of the seal element from applying further force, permitting the setting force to be applied to other non-engaged parts of the seal element. Furthermore, with time the geometry of the hole may change and the described arrangement permits the packer to adapt to these changes and maintain a seal.

Preferably, the at least one spring comprises a plurality of disc springs.

Preferably, the packer further includes a seal backup. A seal back-up is provided to prevent the seal element from collapsing under the setting force.

Preferably, the seal backup comprises a series of interleaved elements.

Preferably, the interleaved elements are mounted externally onto the seal element, or bonded into the seal element. The interleaved elements, like the petals of a closed flower, allow the seal backup to expand sufficiently for the seal element to adopt the set configuration.

Preferably, where the seal element is cup-shaped, the interleaved elements are mounted to an outside surface of the seal element.

According to a second aspect of the present invention there is provided a method of sealing a conduit, the method comprising the steps of:

actuating a packer from a run-in configuration to a set configuration by moving a seal setting apparatus in a setting direction to apply a setting force to a seal element, the seal element forming a contact seal with a wall of the conduit;

such that a pressure differential across the packer which creates a force in the setting direction will increase the setting force applied by the seal setting apparatus to the seal element to maintain the seal.

Preferably, the packer is one of a series of packers.

Preferably, each packer in the series is adapted to be moved from the run-in configuration to the set configuration independently of the other packers.

Preferably, the packers can be moved from the run-in configuration to the set configuration in a user defined sequence.

According to a third aspect of the present invention there is provided a tool for engaging the surface of a non-round hole, the tool comprising:

engagement apparatus adapted, on application of a setting force to move from a run-in configuration to a set configuration in which the engagement apparatus engages the surface of a conduit;

setting force application means for applying the setting force; and a plurality of relief devices adapted to transmit the setting force applied by the setting force application means to the engagement apparatus, each relief device adapted to transmit no-more than a pre-determined force to the engagement apparatus.

Such an arrangement permits a tool to engage the surface of a non-round hole or maintain contact with the surface of a hole which changes geometry over time.

Preferably, the engagement apparatus comprises a seal element for forming a seal with a surface of a conduit.

Alternatively or additionally, the engagement apparatus comprises at least one anchor element for providing an anchor with a surface of a conduit.

It will be understood that the some of the features of the first aspect may be equally applicable to the second and third aspects and have not been repeated for brevity.

By virtue of the present invention a packer is provided, an embodiment of which can form a seal with a conduit wall at a lower contact pressure than conventional packers, the packer being arranged, in use, to harness forces created in the setting direction by a pressure differential across the packer pressure to increase the seal pressure if necessary.

BRIEF DESCRIPTION OF THE DRAWINGS

These and other aspects of the present invention will become apparent from the following description when taken in combination with the accompanying drawings in which.

DETAILED DESCRIPTION OF THE DRAWINGS

Figure 1:
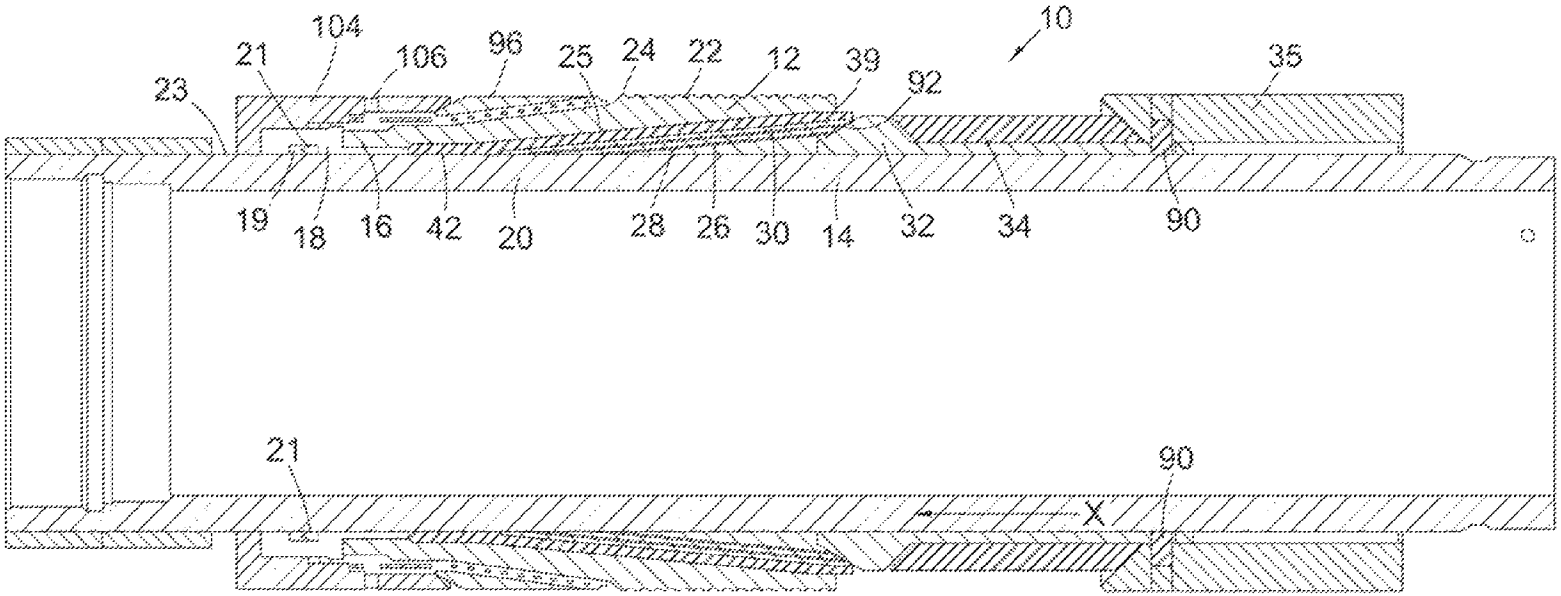
FIG. 1 is a longitudinal sectional view of a packer for a well in a run-in configuration according to a first embodiment of the present invention.
Figure 2:
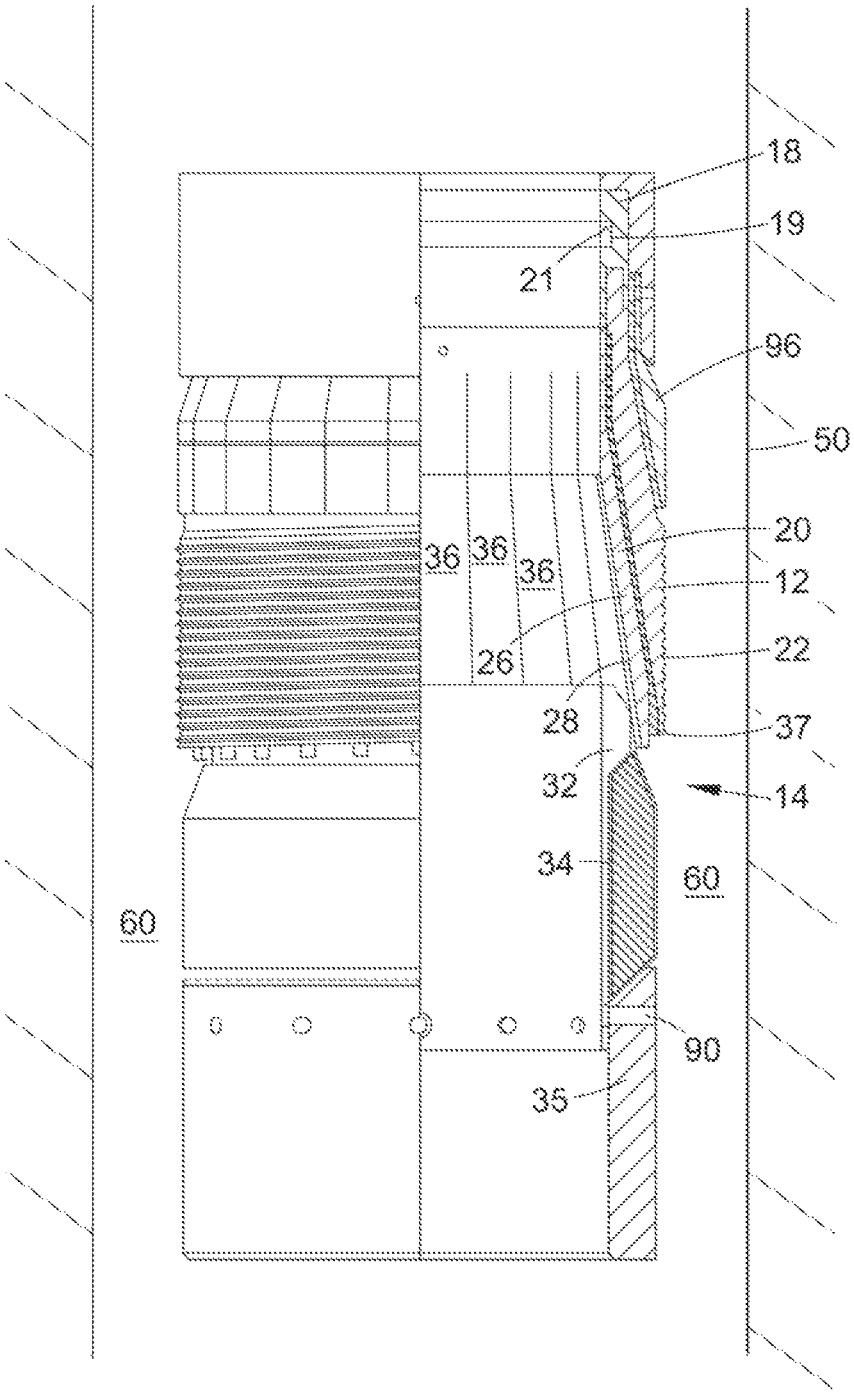
FIG. 2 is a partially cut away side view of part of the packer of FIG. 1 in the run-in configuration.

Referring firstly to FIGS. 1 and 2, FIG. 1 shows a longitudinal sectional view of a packer, generally indicated by reference numeral 10, for a well in a run-in configuration according to a preferred embodiment of the present invention, and FIG. 2 shows a partially cut away side view of part of the packer 10 of FIG. 1. The packer 10 is particularly suited for sealing an unlined well, also known as an open hole.

The packer 10 comprises a rubber cup seal element 12, seal setting apparatus 14, and a mandrel 20. The seal setting apparatus 14 is adapted to apply a setting force in a setting direction (indicated by arrow "X" on FIG. 1) to the seal element 12, to move the seal element 12 from the run-in configuration, shown in FIGS. 1 and 2 to a set configuration shown in FIG. 3; a partially cut away side view of part of the packer 10 of FIG. 1 in a set configuration. The purpose of the packer 10 shown in FIG. 3, is to seal the annulus 60 between the packer mandrel 20 (not shown in FIGS. 2 and 3 for clarity) and the bore wall 50 such that fluid in the annulus 60 below the packer 10 cannot pass the packer 10.

Figure 3:
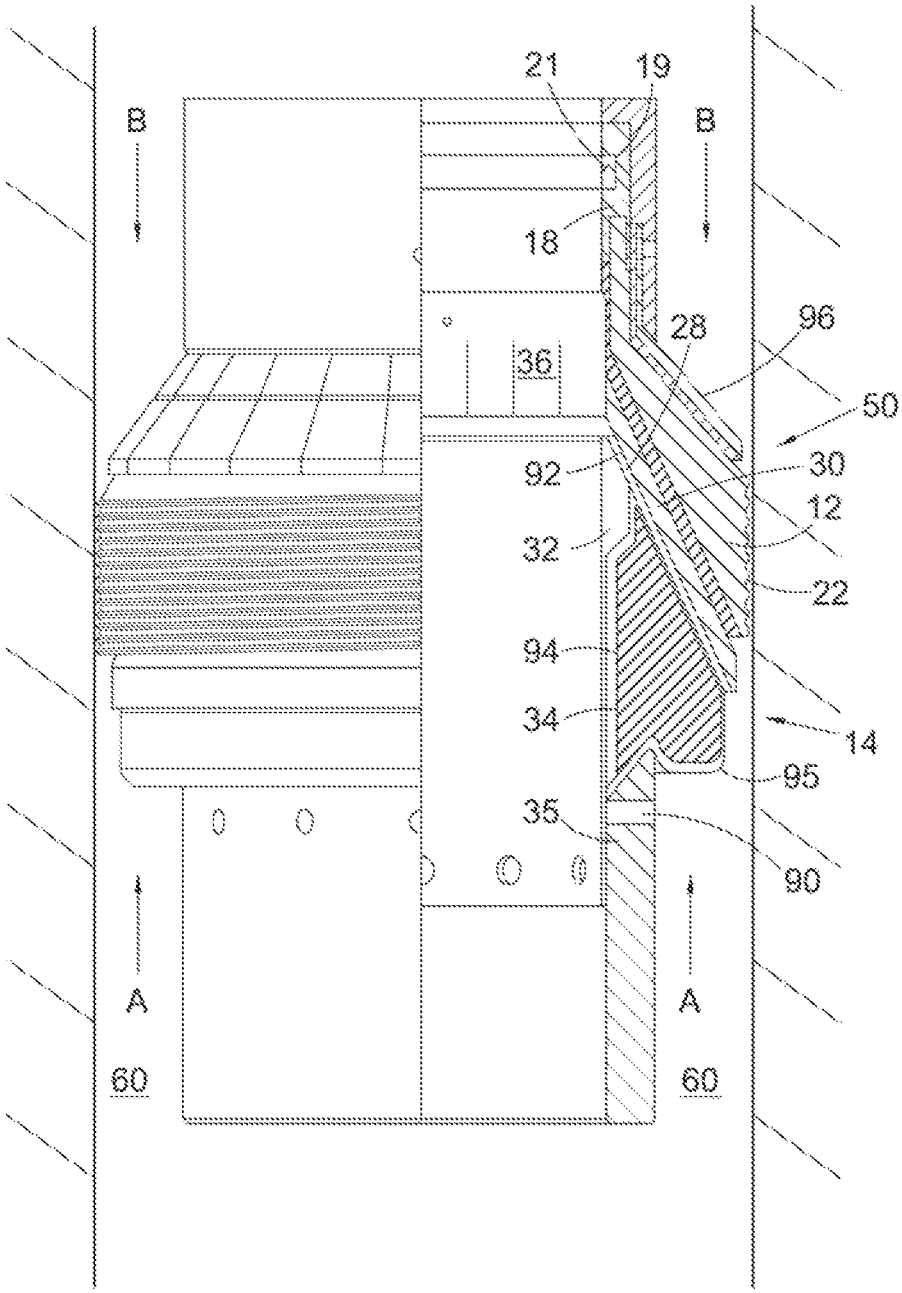
FIG. 3 is a partially cut away side view of part of the packer of FIG. 1 in a set configuration.

Furthermore, the packer 10 is arranged such that, in the set configuration, in which the seal element 12 has engaged and formed a contact seal with the bore wall 50, a pressure differential across the packer 10 which creates a force in the annulus 60 in the direction indicated by arrows A on FIG. 3, will act on the seal setting apparatus 14 and increase the force applied by the seal setting apparatus 14 to the seal element 12 to maintain the seal with the bore wall 50.

Figure 4:
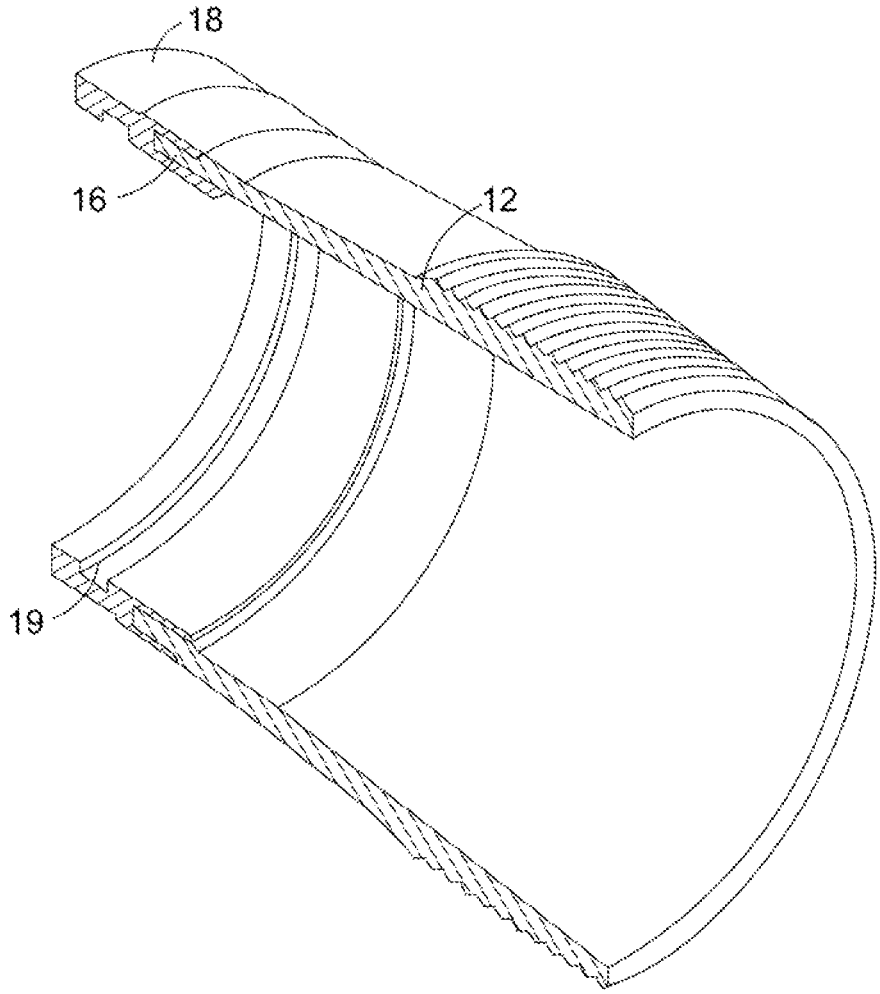
FIG. 4 is a perspective sectional view of the rubber seal element of the packer of FIG. 1.

Referring now to FIG. 1 and FIG. 4; a perspective cut away sectional view of the cup seal element 12, it can be seen that the seal element 12 is coupled at a first end 16 to a seal collar 18. The seal element 12 includes a corrugated sealing surface 22 for forming a seal with the bore wall 50 (FIGS. 2 and 3). The corrugated sealing surface 22 is defined by the outside surface 24 of the seal element 12.

The seal collar 18 defines a bypass seal groove 19. Referring to FIG. 1, the bypass seal is a V-seal 21 and the seal collar 18 is mounted, and axially fixed, to a packer mandrel 20. The V-seal 21 is located in the groove 19 and forms a one way seal against the mandrel outer surface 23. Referring to FIG. 3, the V-seal 21 permits a pressure differential across the packer which creates a force in the direction of arrows B, to by-pass the seal element 12, thereby not affecting the integrity of the seal between the seal element 12 and the bore wall 50, the primary purpose of which is to contain fluid in the annulus 60 below the packer 10.

Referring back to FIG. 1, the seal setting apparatus 14 comprises a plurality of elongate elements 26 arranged in two layers; an inner layer 28 and an outer layer 30. The seal setting apparatus further comprises a setting sleeve 32, a compliant prop 34 and a prop support sleeve 35. The prop support sleeve 35 is releasably attached to the setting sleeve 32 by means of shear screws 90.

Figure 5:
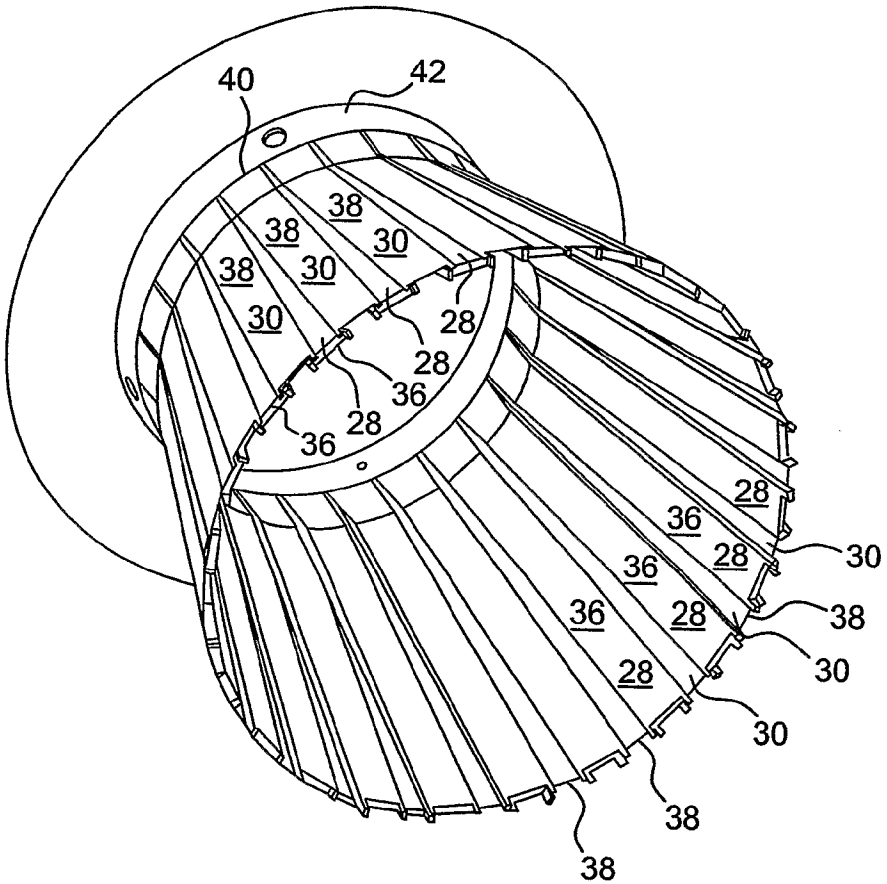
FIG. 5 is a perspective view of the elongate elements of the packer of FIG. 1 in the set configuration

The seal setting apparatus elongate elements 26 can be seen more clearly in FIG. 5, a perspective view of the elongate elements 26 in the set configuration. As can be seen, each layer 28, 30 comprises a plurality of elongate elements 26 in the form of steel leaf springs 36, 38. Each leaf spring 36, 38 is attached at a first end 40 to a leaf spring collar 42 which is in turn attached to the mandrel 20, preventing axial movement of the elongate elements 26 with respect to the mandrel 20. The leaf springs 36, 38 are biased towards the run-in configuration to permit removal of the packer 10 from the conduit 60.

The leaf springs 36, 38 are arranged such that in the set configuration, the outer layer leaf springs 38 overlap the gaps between the inner layer leaf springs 36. As the leaf springs 36, 38 diverge from the run-in to the set configuration, a continuous surface is therefore provided for engagement with, and applying a setting force to, the inside surface 25 of the rubber seal element 12. A low friction PTFE layer 39 (FIG. 1) is sandwiched between the seal element 12 and the leaf springs 36, 38 to protect the seal element 12 from damage which may otherwise be caused by movement of the leaf springs 36, 38 as they move from the run-in to the set configuration.

Figure 6:
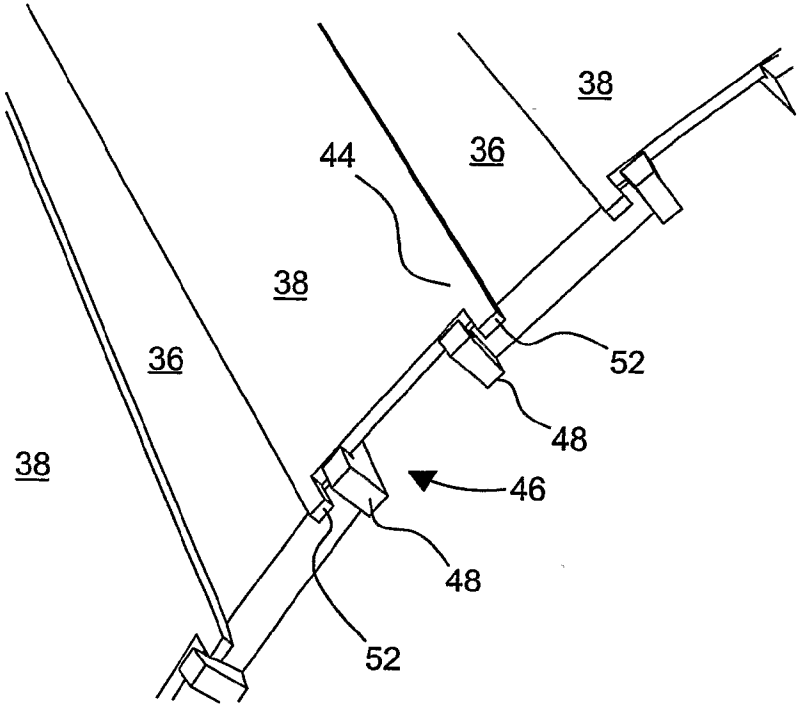
FIG. 6 is an enlarged view of a portion of the elongate elements of FIG. 5.

Referring now to FIG. 6, an enlarged view of a portion of the seal setting apparatus leaf springs 36, 38, it can be seen that at a second end 44 of each leaf spring 36, 38 engagement means 46 are provided. The engagement means are in the form of co-operating lugs 48,52 attached to the second ends 44 of inner and outer layer leaf springs 36,38 respectively. In the fully set configuration, each inner layer leaf spring lug 48 engages an outer layer leaf spring lug 52, preventing further divergence of the seal setting apparatus leaf springs 36, 38. In this position the leaf springs 36, 38 have reached maximum expansion. Provision of the engagement means 46 prevents the leaf springs 36, 38 over extending and gaps opening up between the inner and outer layers 28, 30.

Provision of a plurality of individual leaf springs 36, 38 permits the seal setting apparatus 14 to conform to non-circular conduits.

The setting force applied to the seal element 12 to move the seal element 12 from the run-in to the set configuration is applied by applying a force to leaf springs 36, 38 through axial movement of the setting sleeve 32 in the setting direction, the compliant prop 34 and the prop support sleeve 35 towards the leaf springs 36, 38.

The application of the force to the leaf springs 36, 38 by the axial movement of the setting sleeve 32, the compliant prop 34 and the prop support sleeve 35 will now be described. Referring to FIG. 1, the prop support sleeve 35 is releasably pinned to the setting sleeve by a plurality of shear screws 90. A hydraulically applied force axial force is applied to the setting sleeve 32 from surface via a setting line (not shown) to move the setting sleeve 32 in the setting direction towards and underneath the leaf springs 36, 38. The setting sleeve 32 engages the inner layer 28 of leaf springs 36 and applies a radial setting force to the leaf springs 36,38. This force is transferred by the leaf springs 36, 38 to the seal element 12 pushing the seal element 12 into a sealing engagement with the bore wall 50.

As can be seen from FIGS. 1 to 3, the setting sleeve leading edge 92 has a relatively small area of contact area with the lower portion of each leaf spring 36, 38. Force is applied to the upper portion of each leaf spring 36, 38 by the compliant prop 32.

Once the setting sleeve 32 has reached the extent of its axial travel, the continued application of the axial force to the prop support sleeve 35 overcomes the shear screws 90 permitting the prop support sleeve 35 to move axially along the setting sleeve 32. The compliant prop 34 is squeezed into engagement with the underside of the leaf springs 36, 38 by the prop support sleeve 35. Continued application of the axial force to the prop support sleeve 35 maintains the compliant prop 34 in contact with the leaf springs 36, 38.

The compliant prop is made from an annular piece of rubber 94 covered with an anti-extrusion layer 95 of plastic (FIG. 3). The anti-extrusion layer 95 permits the force applied by the prop support sleeve 35 to the compliant prop 34 to be substantially transferred by the compliant rubber 94 to the leaf springs 36, 38.

Figure 7:
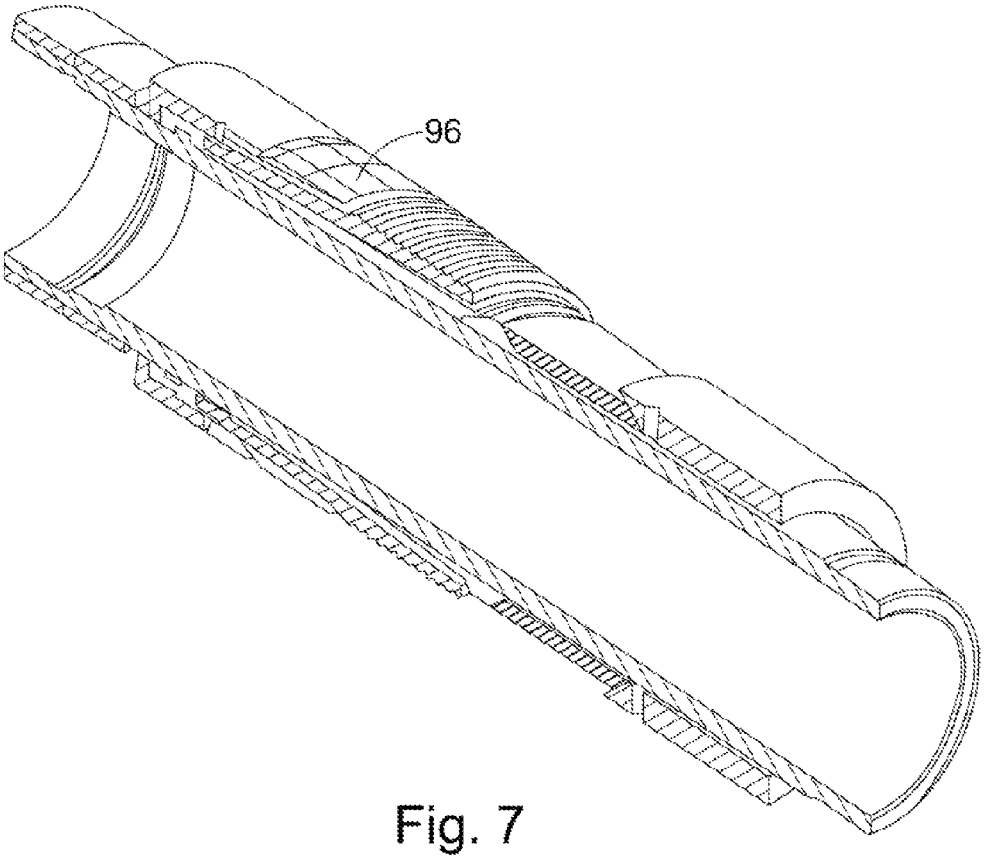
FIG. 7 is a perspective sectional view of the packer of FIG. 1.

Referring now to FIGS. 1, 3 and 7; a cut away perspective view of the packer of FIG. 1, it can be seen that the packer 10 further includes a seal back up system 96. The seal back up system 96 acts against the seal element 12 to maintain contact between the seal element 12 and the bore wall 50 in the set configuration.

In the set configuration, particularly when there is a pressure force acting in the direction of arrows A (FIG. 3), the force acting on the seal element 12 will push the element 12 against the bore wall 50. The seal back up system 96 prevents the seal element from deforming away from the force and reducing the pressure of the contact between the seal element 12 and the bore wall 50.

Figure 8:
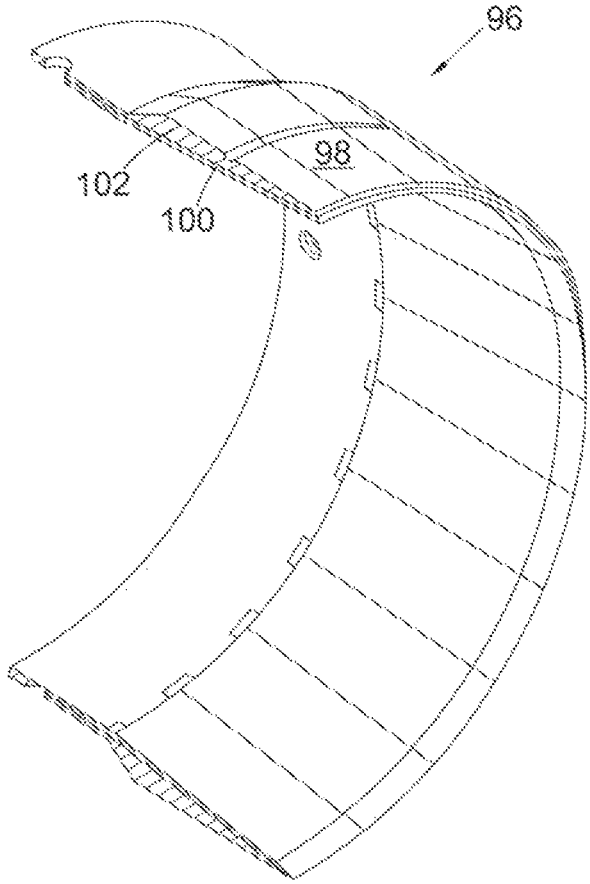
FIG. 8 is a perspective sectional view of the seal back up system of the packer of FIG. 1.
Figure 9:
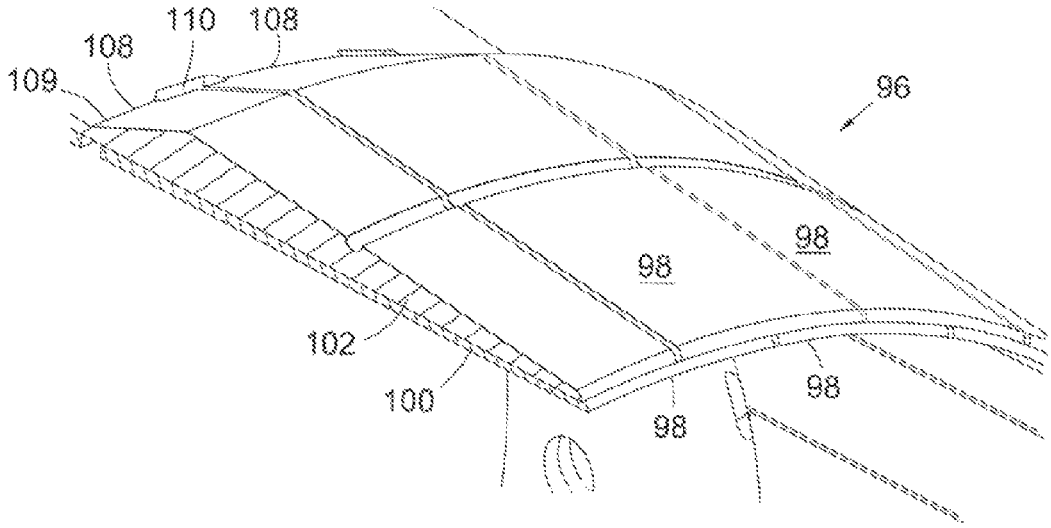
FIG. 9 an enlarged perspective view of a portion of the seal back up system of FIG. 8.

The seal back up system 96 is best seen in FIG. 8, a perspective cut away view of the seal back up system 96 of the packer of FIG. 1, and FIG. 9, an enlarged perspective view of a portion of the seal back up system 96 of FIG. 8.

The seal back up system 96 comprises a plurality of back up elements 98. Like the seal setting apparatus leaf springs 36, 38, the back up elements 98 are arranged in an inner layer 100 and an outer layer 102. The inner and outer layers 100, 102 overlap such that in the set configuration gaps between the elements of the inner layer 100 are covered by the elements of the outer layer 102. As there are no gaps the seal back up system 96 presents a continuous surface to seal element 12 in the set configuration, ensuring that the pressure in the seal element 12 can be released by part of the seal element 12 extruding between the back up elements 98.

Each back up element 98 moves from the run-in configuration shown in FIGS. 8 and 9 to the set configuration shown in FIG. 3 by bending about a living hinge 108 located at the root 109 of each element 98 (FIG. 9). A slot 110 is provided between adjacent elements 98 to narrow each element root 109 to facilitate bending of each element 98 about its hinge 108.

Referring to FIG. 1, the seal back up system 96 is pinned to a shroud 104 by pins 106. The shroud 104 is attached to the packer mandrel 20 preventing axial movement of the seal back up system 96.

Figure 10:
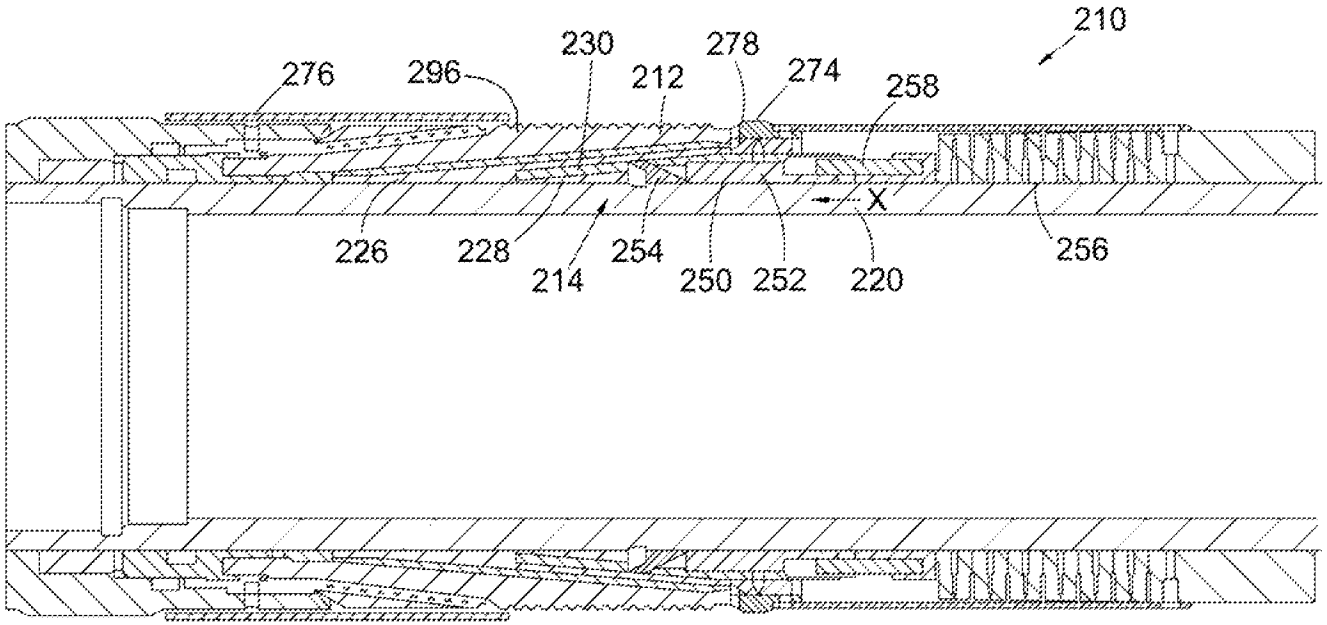
FIG. 10 is a longitudinal sectional view of a packer for a well in a run-in configuration according to a second embodiment of the present invention.

Referring now to FIG. 10, there is shown a sectional view of a packer 210 for a well in a run-in configuration according to a second embodiment of the present invention.

Like the first embodiment, the packer 210 is particularly suited for sealing an unlined bore. The packer 210 comprises a rubber cup seal element 212, seal setting apparatus 214 and a mandrel 220. The seal setting apparatus 214 is adapted to apply a setting force in a setting direction (indicated by arrow "X" on FIG. 10) to the seal element 212 to move the seal element 212 from the run-in configuration shown in FIG. 10 to a set configuration shown in FIG. 11; an enlarged longitudinal section view of part of the packer 210 of FIG. 1 in a set configuration.

The arrangement of overlapping elongate elements 226 (inner layer 228, outer layer 230) and the overlapping seal back-up system 296 is the same as for the packer 10 of the first embodiment. However, there are a number of differences between the second embodiment packer 210 and the first embodiment packer 10. For example, packer 210 of FIG. 10 does not use a setting sleeve, compliant prop or prop support sleeve to apply the setting force to the elongate elements 226, instead there are twenty-four setting members 250 spaced at 15° intervals, each setting member 250 comprising a setting member body 252 and a setting member lever 254.

Figure 12:
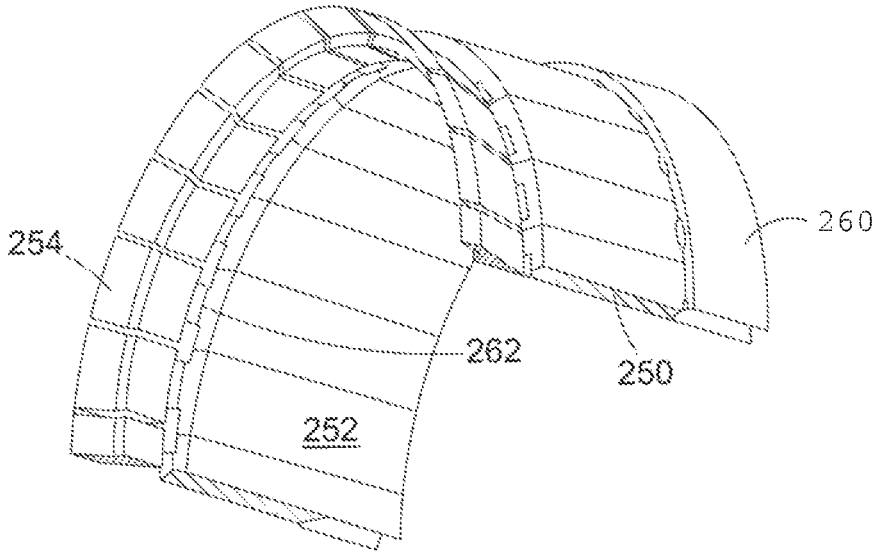
FIG. 12 is a perspective view of part of the setting member of the packer of FIG. 10.

Referring briefly to FIG. 12, a perspective cut-away view of the setting members 250 of the packer 210, it can be seen that each setting member 250 is mounted on a setting member collar 260. Still referring to FIG. 12, it can be seen that each lever 254 is joined to its respective setting member body 252 by a living hinge 262. The purpose of this hinge 262 will be discussed in due course.

Referring back to FIG. 10, a force sufficient to form a low pressure seal is applied to the setting members 250 by twelve disc springs 256, the disc springs 256 collectively apply the force to each setting member 250 through a relief device 258. There are twenty-four relief devices 258, one associated with each of the setting members 250. The setting force is applied to the setting members 250 through the disc springs 256 by hydrostatic pressure acting on an atmospheric chamber (not shown).

Figure 11:
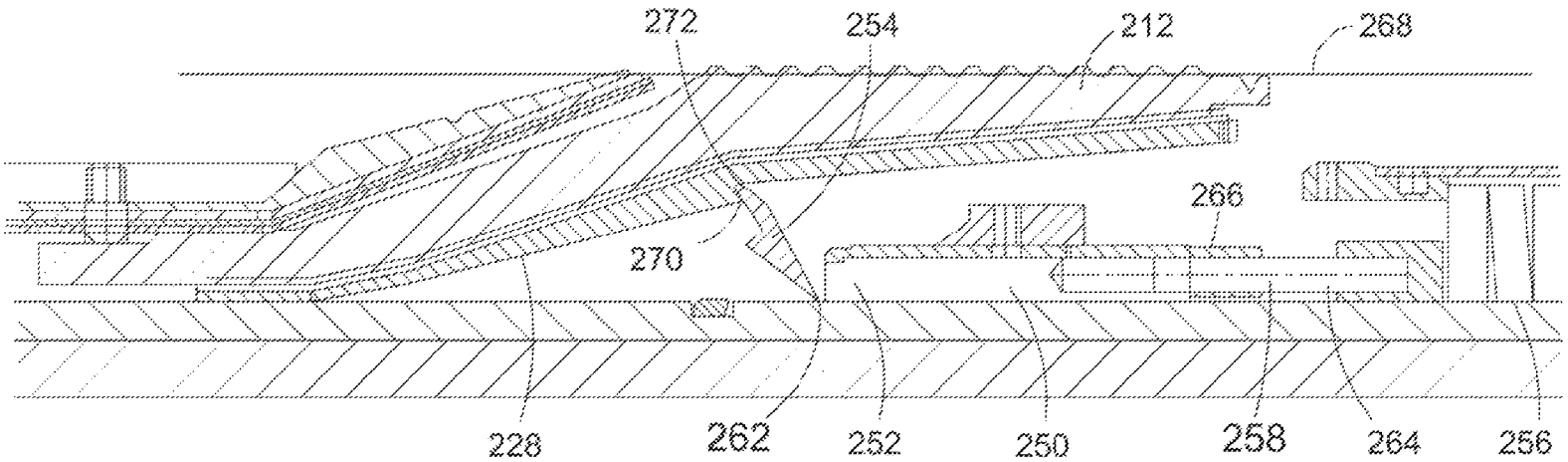
FIG. 11 is an enlarged, longitudinal section view of part of the packer of FIG. 10 in a set configuration.

Referring to FIG. 11, each relief device 258 comprises a pin 264 and a collar 266. An interference exists between each pin 264 and its respective collar 266, the interference being chosen such that the pin 264 will move with respect to the collar 266 once a given threshold value of pressure is exceeded.

To move from the run-in configuration, shown on FIG. 10 to the set configuration shown on FIG. 11, the setting force is applied to the setting members 250 through the disc springs 256. The setting force is 12,000 lbs of force and is applied across the setting members 250 through the relief devices 258. This force causes the setting members 250 and the relief devices 258 to move axially with respect to the mandrel 220 in the direction of arrow "X". As the setting members 250 move with respect to the mandrel 220, the setting member levers 254 engage the inner layer of seal elements 220, pushing the seal element 212 radially outwards towards the conduit wall 268.

The inner layer of seal elements 228 define a catch 270 (shown most clearly on FIG. 11). As the levers 254 move axially along the mandrel 220, the tips 272 of the levers 254 approach and engage the catch 270. This engagement prevents further axial movement of the levers 254 and continued axial movement of the setting member body 252 causes each lever 254 to pivot about its respective hinge 262 with respect to its respective setting member body 252. This pivoting action provides a large radial extension of the seal element 212 for a relatively small axial movement of the setting member body 252. As the levers 254 pivot, the seal element 212 is translated into engagement with the conduit wall 268. Once the seal element 212 engages the wall 268, a contact seal is formed and continued application of the setting force increases the pressure between the seal element 212 and the wall 268. As the pressure increases, the pressure on the wall 268 increases. The relief devices 258 are provided to prevent the pressure on the wall 268 increasing to a level which results in a fracture of the wall 268, as will now be discussed.

Referring now to FIG. 11, the threshold force at which the relief device pin 264 will move with respect to the relief device collar 266 is chosen at a level which is high enough to create a seal between the seal element 212 and the conduit wall 268, but not great enough to cause the conduit wall 268 to fracture. In the embodiment shown in FIGS. 10 and 11, the selected threshold force is 500 lbs.

The relief devices 258 operate as follows: in an oval hole, the portion of the seal element radially displaced by, for example, a first setting member 250 will engage and seal against the conduit wall 268 before a second portion of the seal element 212 associated with a second setting member 250. Once the portion of the seal element 212 associated with the first setting member 250 has engaged the wall 268, and the setting force applied by the spring 256 has reached 500 lbs, the relief device pin 264 will overcome the interference between the pin 264 and the collar 266, and the pin 264 will slip with respect to the relief device collar 266. This movement prevents further axial movement of the setting member 250, and hence radial movement of the seal element 212.

Continued application of the setting force will act on the other setting members 250 which have not yet achieved a seal between their respective portions of the seal element 212 and the conduit wall 268. Once all twenty-four setting members 250 have achieved engagement with the conduit wall 268, the 12,000 lbs of setting force will be evenly spread right around the seal element 212 with 500 lbs of force being applied by each setting member 250 to the seal element 212.

Referring back to FIG. 10, there are a number of further features of the packer 210 which are different to the packer 10 of the first embodiment. For example, the cup seal element 212 is bonded in the run-in configuration to a packer band 274. The bonding prevents the seal element 212 prematurely setting during, for example, swabbing. As the setting force is applied to the seal element 212 to move it from the run-in configuration to the set configuration, the seal element 212 tears away from the packer band 274.

The packer band 274 also includes a deflection surface 278 to deflect fluid flowing passed the packer 210 in the run-in configuration from prematurely setting the seal element.

The packer 210 also comprises a plastic shrink-wrap 276 which covers the entire seal back-up system preventing the seal element 212 deploying prematurely during run-in as the packer 210 passes through fluid in the conduit.

Figure 13:
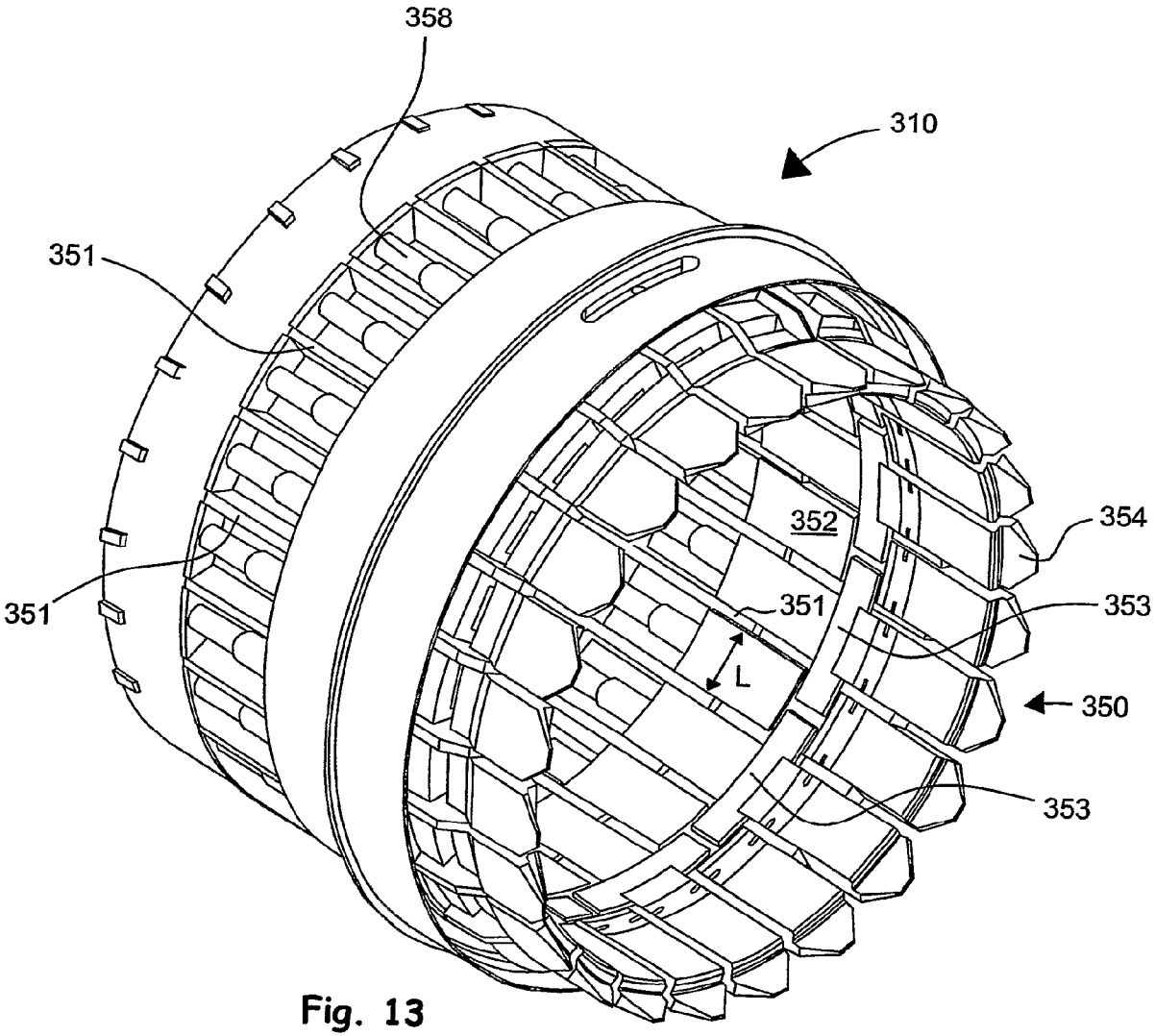
FIG. 13 is a perspective view of part of a packer for a well according to a third embodiment of the present invention.

FIG. 13 shows a perspective view of part of a packer 310 for a well according to a third embodiment of the present invention. The part of the packer 310 shown includes twenty four setting members 350, each setting member comprising a setting member body 352 and a setting member lever 354. Also visible on FIG. 13 are twenty four relief devices 358. The setting members 350 and relief devices 358 of the packer 310 have the same functionality as those of the packer 210 of the second embodiment. However, the part of the packer 310 shown in FIG. 13 further includes twenty four webs 351 and twelve restraining members 353.

The webs 351 are provided to prevent lateral movement (or side-to-side movement in the direction of arrow "L") of the setting members 350 during expansion of the packer seal element (not shown).

Each restraining member 353 spans three setting members 350. The setting members 350 can move with respect to the restraining member(s) 353 with which they are associated, however radially outward movement of one setting member 350 beyond a pre-determined threshold distance from the setting member 350 adjacent to it is prevented by the restraining member 353. Such an arrangement prevents over expansion of one setting member 350 with respect to its neighbour.

Figure 14:
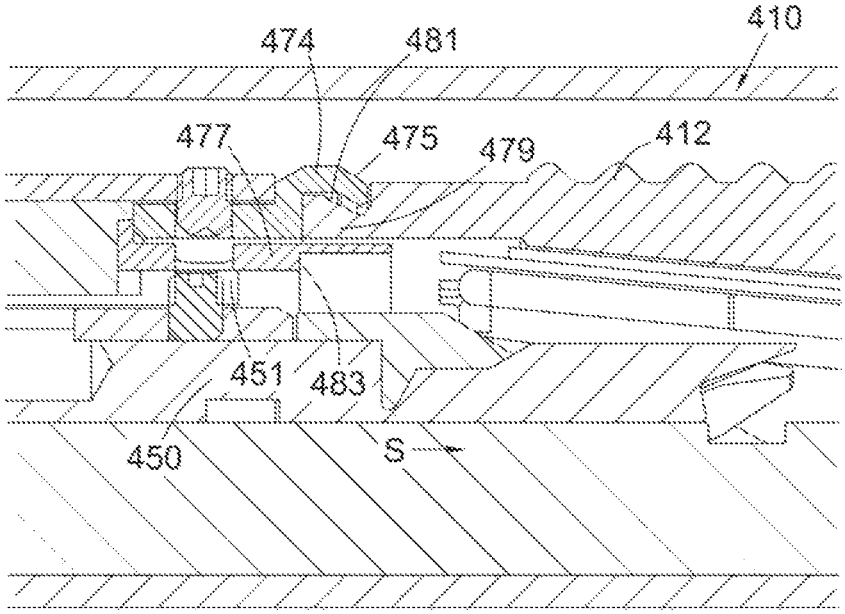
FIG. 14 is an enlarged close up view of a section of a packer according to a fourth embodiment of the present invention.

Finally, reference is made to FIG. 14, an enlarged close up view of a section of a packer 410 according to a fourth embodiment of the present invention. This Figure particularly shows an alternative method of maintaining the seal element 412 in the run-in configuration. The packer 410 includes a packer band 474 which defines a C-section profile 475 and a support collar 477. As can be seen from FIG. 14 the seal element tip 479 is sandwiched between the packer band profile 475 and the support collar 477, the profile 475 engaging a circumferential recess 481 defined by the seal element 412. The support collar 477 is in turn sandwiched between the packer band 474 and the setting members 450, the support collar 477 engaging with a setting member surface 451. During setting, as the setting members 450 move in the direction of arrow "S" relative to the support collar 477. When the setting member surface 451 clears a support collar shoulder 483, the support collar is no longer supported and the seal element 412 can pull clear of the packer band 474 under the action of the setting force applied to the seal element 412 by the setting members 450.

Various modifications may be made to the embodiments described above without departing from the scope of the invention. For example, the packer may also be used as a plug or a straddle. In a further embodiment, the setting sleeve may be actuated in the setting direction by application of a mechanical force.

It will be appreciated that the principal advantage of the above described embodiments is that a seal can be formed with a conduit wall at a lower contact pressure than conventional packers. This reduces the possibility of damage to the formation wall. A pressure differential across the packer creates a force in the setting direction, the increased force being harnessed by the packer to increase the seal pressure and maintain the seal. Furthermore, the packer described in the embodiments is arranged to be useable in both round and non-round holes, and can accommodate, and maintain a seal, at least some changes in the geometry of the hole.

Throughout the specification, unless the context requires otherwise, the word "comprise", or variations such as "comprises" or "comprising", will be understood to imply the inclusion of a stated integer or group of integers but not the exclusion of any other integer or group of integers.

The invention claimed is:

1. A packer for a well, the packer comprising:

a seal element; and a seal setting apparatus comprising a plurality of elongate elements disposed so as to engage a portion of an inside surface of the seal element, each elongate element having a first end and a second end, the seal setting apparatus being moveable with respect to the seal element in a setting direction to apply a setting force to the seal element to move the seal element from a run-in configuration to a set configuration; wherein, in use, the packer is arranged such that in the set configuration:

the second ends of the elongate elements extend radially outwards;

the seal element comprises a cup seal forming a contact seal with a conduit wall; and a pressure differential across the packer, which creates a force in the setting direction, will increase the setting force applied by the seal setting apparatus to the seal element to maintain the contact seal.

2. The packer of claim 1, wherein the packer further comprises a mandrel, the mandrel defining a packer throughbore.

3. The packer of claim 2, wherein at least one first portion of the seal element is fixed with respect to the mandrel.

4. The packer of claim 3, wherein at least one second portion of the seal element is releasably fixed with respect to the mandrel.

5. The packer of claim 4, wherein said at least one second portion is releasably fixed with respect to the mandrel in the run-in configuration.

6. The packer of claim 5, wherein movement of the seal setting apparatus from the run-in configuration to the set configuration releases said at least one second portion.

7. The packer of claim 4, wherein said at least one second portion is fixed to a packer band.

8. The packer of claim 7, wherein said at least one second portion is releasably fixed to the packer band.

9. The packer of claim 1, wherein the seal element has a sealing surface for forming said contact seal, in use, with said conduit wall.

10. The packer of claim 9, wherein the sealing surface is a portion of the outside surface of the seal element.

11. The packer of claim 10, wherein the sealing surface includes a profiled portion.

12. The packer of claim 11, wherein the profile is a corrugated profile.

13. The packer of claim 1, wherein the packer is adapted to seal an annulus between a conduit wall and a tubular.

14. The packer of claim 1, wherein the seal element comprises an elastomeric material.

15. The packer of claim 14, wherein the seal element comprises rubber.

16. The packer of claim 1, wherein the seal setting apparatus is adapted to engage a first portion of the seal element, such that, in use, the sealing surface of the seal element forms a seal with a conduit.

17. The packer of claim 1, wherein said first end is fixed relative to the mandrel.

18. The packer of claim 1, wherein the first end of each elongate element is fixed relative to the mandrel, wherein the packer further comprises a mandrel, the mandrel defining a packer throughbore, and wherein in the run-in configuration, the elongate element is arranged substantially axially with the packer mandrel.

19. The packer of claim 1, wherein the plurality of elongate elements are a plurality of leaf springs.

20. The packer of claim 1, wherein a seal element bypass is provided to, in use, relieve a pressure differential across the packer which creates a force in a direction opposite the setting direction.

21. The packer of claim 20, wherein the bypass includes a seal which only seals in one direction.

22. The packer of claim 1, wherein the first end is connected to a collar.

23. The packer of claim 22, wherein the packer further comprises a mandrel, the mandrel defining a packer throughbore, and wherein the collar is mounted to the mandrel.

24. The packer of claim 23, wherein the collar defines a groove adapted to accommodate the bypass seal.

25. The packer of claim 24, wherein the groove is located such that the bypass seal forms a one way seal against the mandrel.

26. The packer of claim 1, wherein the elongate elements are arranged in a plurality of concentric layers.

27. The packer of claim 26, wherein there are two concentric layers.

28. The packer of claim 27, wherein the two concentric layers are an outer layer and an inner layer.

29. The packer of claim 28, wherein the inner layer of elongate elements are relatively thick compared to the outer layer.

30. The packer of claim 28, wherein the outer layer of elongate elements are adjacent the seal element.

31. The packer of claim 27, wherein the elongate elements in the outer layer overlap the elongate elements in the inner layer.

32. The packer of claim 1, wherein a protective layer is sandwiched between the seal element and the at least one elongate element.

33. The packer of claim 32, wherein the protective layer is integral with the seal element, wherein said protective layer is moulded as part of, or bonded to, the seal element.

34. The packer of claim 32, wherein the protective layer comprises a polymeric material.

35. The packer of claim 1, wherein the second end of each elongate element includes an engagement arrangement for engaging one or more elongate element in the adjacent layer.

36. The packer of claim 1, wherein the seal setting apparatus comprises a plurality of setting members.

37. The packer of claim 36, wherein said setting members are adapted to engage and apply at least a portion of the setting force to said elongate elements.

38. The packer of claim 36, wherein the packer further comprises a mandrel, the mandrel defining a packer throughbore, and wherein the setting members are adapted to move with respect to the packer mandrel.

39. The packer of claim 36, wherein the setting members are adapted to move axially.

40. The packer of claim 36, wherein each setting member comprises a body and a lever.

41. The packer of claim 40, wherein each lever is adapted to engage and apply the at least a portion of the setting force to said elongate elements.

42. The packer of claim 40, wherein the lever is hingedly attached to the body.

43. The packer of claim 42, wherein the lever is hingedly attached to the body by a living hinge.

44. The packer of claim 40, wherein as the setting members move with respect to the mandrel, at a predetermined location, the levers are prevented from further axial movement with respect to at least one elongate element.

45. The packer of claim 44, wherein further axial movement of each setting member body causes each setting member's respective lever to pivot with respect to the body.

46. The packer of claim 45, wherein each lever is adapted to pivot radially outwards.

47. The packer of claim 45, wherein each lever pivots towards said elongate elements.

48. The packer of claim 1, wherein the seal setting apparatus further comprises at least one web.

49. The packer of claim 48, wherein the at least one web is axially extending.

50. The packer of claim 48, wherein the packer further comprises a mandrel, the mandrel defining a packer throughbore, wherein the at least one web is fixed with respect to a mandrel.

51. The packer of claim 48, wherein the seal setting apparatus comprises a plurality of setting members, and wherein a web is located between adjacent seal setting members.

52. The packer of claim 51, wherein said web is adapted to prevent lateral movement of adjacent seal setting members.

53. The packer of claim 1, wherein the seal setting apparatus further comprises at least one restraining member.

54. The packer of claim 53, wherein a restraining member is associated with a plurality of seal setting members.

55. The packer of claim 54, wherein the seal setting apparatus comprises a plurality of setting members, wherein said setting members are adapted to engage and apply at least a portion of the setting force to said elongate elements, wherein the setting members are adapted to move axially, wherein the setting members are adapted to move axially, and wherein each setting member comprises a body and a lever; wherein said lever is adapted to engage and apply the at least a portion of the setting force to said elongate elements, wherein the lever is hingedly attached to the body, wherein the lever is hingedly attached to the body by a living hinge, wherein each lever is adapted to pivot radially outwards, and wherein each lever pivots towards said elongate elements; wherein the packer further comprises a mandrel, the mandrel defining a packer throughbore, and wherein the setting members are adapted to move with respect to the packer mandrel; wherein as the setting members move with respect to the mandrel, at a predetermined location, the levers are prevented from further axial movement with respect to at least one elongate element and wherein further axial movement of each setting member body causes each setting member's respective lever to pivot with respect to the body; and wherein said restraining members are adapted to restrain the movement of one seal setting member with respect to an adjacent seal setting member.

56. The packer of claim 55, wherein each pair of seal setting members is adapted to move with respect to their associated restraining member.

57. The packer of claim 1, wherein the seal setting member comprises a prop for supporting said elongate elements and a setting sleeve, the prop being mounted on the setting sleeve.

58. The packer of claim 1, wherein the packer further comprises at least one spring.

59. The packer of claim 58 wherein the seal setting apparatus comprises a plurality of setting members, and wherein where the seal setting apparatus comprises a plurality of setting members, wherein said at least one-spring is adapted to act on each setting member.

60. The packer of claim 59, wherein the spring acts on each setting member through a relief device.

61. The packer of claim 60, wherein there is a relief device associated with each setting member.

62. The packer of claim 61, wherein each relief device is adapted to transmit the setting force to the device's respective setting member.

63. The packer of claim 62, wherein each relief device is adapted to transmit no more than a pre-determined force to the device's respective setting member.

64. The packer of claim 58, wherein the setting force is transmitted to the seal setting apparatus through said at least one spring.

65. The packer of claim 58, wherein the at least one spring comprises a plurality of disc springs.

66. The packer of claim 1, wherein the packer further includes a seal backup.

67. The packer of claim 66, wherein the seal backup comprises a series of interleaved elements.

68. The packer of claim 67, wherein the interleaved elements are mounted externally onto the seal element, or bonded into the seal element.

69. The packer of claim 68, wherein the seal element comprises a cup seal, and wherein the interleaved elements are mounted to an outside surface of the seal element.

70. A method of sealing a conduit, the method comprising the steps of:

actuating a packer from a run-in configuration to a set configuration by moving a seal setting apparatus comprising a plurality of elongate elements in a setting direction, the elongate elements disposed so as to engage a portion of an inside surface of a cup seal element and each having a first end and a second end; and extending the second ends of the elongate elements radialy outwards to apply a setting force to the cup seal element, the cup seal element forming a contact seal with a wall of the conduit; wherein, a pressure differential across the packer which creates a force in the setting direction will increase the setting force applied by the seal setting apparatus to the seal element to maintain the seal.

71. The method of claim 70, wherein the packer is one of a series of packers.

72. The method of claim 71, wherein each packer in the series is adapted to be moved from the run-in configuration to the set configuration independently of the other packers.

73. The method of claim 70, wherein the packers can be moved from the run-in configuration to the set configuration in a user defined sequence.

74. A packer for a well, the packer comprising:

a seal element; and a seal backup; and a seal setting apparatus comprising a plurality of elongate elements having a first end and a second end, the seal setting apparatus being moveable with respect to the seal element in a setting direction to apply a setting force to the seal element to move the seal element from a run-in configuration to a set configuration; wherein, in use, the packer is arranged such that in the set configuration:

the second ends of the elongate elements extend radially outwards;

the seal element comprises a cup seal forming a contact seal with a conduit wall; and a pressure differential across the packer, which creates a force in the setting direction, will increase the setting force applied by the seal setting apparatus to the seal element to maintain the contact seal.

* * * * *